US009647339B2

(12) United States Patent
Lo et al.

(10) Patent No.: US 9,647,339 B2
(45) **Date of Patent: *May 9, 2017**

(54) WEARABLE DEVICE

(71) Applicant: Quanta Computer Inc., Taoyuan (TW)

(72) Inventors: Chung-Hung Lo, Taoyuan (TW); Chin-Lung Tsai, Taoyuan (TW); Chung-Ting Hung, Taoyuan (TW); Kuan-Hsien Lee, Taoyuan (TW); Ying-Cong Deng, Taoyuan (TW); Chun-Lung Chen, Taoyuan (TW); Yu-Liang Chen, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 20 days.

This patent is subject to a terminal disclaimer.

(21) Appl. No.: 14/741,879

(22) Filed: Jun. 17, 2015

(65) Prior Publication Data

US 2016/0294038 A1 Oct. 6, 2016

(30) Foreign Application Priority Data

Mar. 30, 2015 (TW) ..... 104110186 A

(51) Int. Cl.

| | |
|---|---|
| ***H01Q 1/12*** | (2006.01) |
| ***H01Q 7/00*** | (2006.01) |
| ***H01Q 1/48*** | (2006.01) |
| ***H01Q 1/27*** | (2006.01) |
| ***H01Q 5/328*** | (2015.01) |

(52) U.S. Cl.

CPC ..... *H01Q 7/00* (2013.01); *H01Q 1/273* (2013.01); *H01Q 1/48* (2013.01); *H01Q 5/328* (2015.01)

(58) Field of Classification Search

CPC .. H01Q 1/22; H01Q 1/48; H01Q 1/50; H01Q 7/00; G04B 37/1486

USPC ..... 343/702, 718, 744, 745, 750

See application file for complete search history.

(56) References Cited

U.S. PATENT DOCUMENTS

| | | | | |
|---|---|---|---|---|
| 9,024,823 | B2 | 5/2015 | Bevelacqua | |
| 9,141,089 | B1 * | 9/2015 | Liou | G04R 60/14 |
| 2006/0083115 | A1 * | 4/2006 | Lafever | G04B 37/1486 368/282 |
| 2011/0013491 | A1 * | 1/2011 | Fujisawa | G04R 60/06 368/10 |

(Continued)

FOREIGN PATENT DOCUMENTS

| | | |
|---|---|---|
| TW | M397609 | 2/2011 |
| TW | 201251202 | 12/2012 |
| TW | 201507261 | 2/2015 |

OTHER PUBLICATIONS

Chinese language office action dated Feb. 23, 2016, issued in application No. TW 104110186.

*Primary Examiner* — Jean B Jeanglaude

(74) *Attorney, Agent, or Firm* — McClure, Qualey & Rodack, LLP

(57) ABSTRACT

A wearable device includes a nonconductive base, a metal loop, and a matching circuit. The nonconductive base substantially has a hollow structure. The metal loop is disposed on the nonconductive base, and has a feeding point and a grounding point. The metal loop has at least one notch. The grounding point of the metal loop is coupled through the matching circuit to a ground voltage. An antenna structure of the wearable device is formed by the metal loop and the matching circuit.

6 Claims, 7 Drawing Sheets

(56) References Cited

U.S. PATENT DOCUMENTS

2015/0048979 A1* 2/2015 Asrani ..... H01Q 5/0093
343/702

* cited by examiner

WEARABLE DEVICE

CROSS REFERENCE TO RELATED APPLICATIONS

This Application claims priority of Taiwan Patent Application No. 104110186 filed on Mar. 30, 2015, the entirety of which is incorporated by reference herein.

BACKGROUND OF THE INVENTION

Field of the Invention

The disclosure generally relates to a wearable device, and more specifically, to a wearable device including an antenna structure.

Description of the Related Art

With the progress of mobile communication technology, mobile devices such as portable computers, mobile phones, tablet computers, multimedia players, and other hybrid functional mobile devices have become common. To satisfy the demand of users, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

According to some research reports, researchers predict that the next generation of mobile devices will be "wearable devices". For example, wireless communication may be applied to watches, glasses, and even clothes in the future. However, watches, for example, do not have a large enough space to accommodate antennas for wireless communication. Accordingly, this has become a critical challenge for antenna designers.

BRIEF SUMMARY OF THE INVENTION

In a preferred embodiment, the disclosure is directed to a wearable device including a nonconductive base, a metal loop, and a matching circuit. The nonconductive base substantially has a hollow structure. The metal loop is disposed on the nonconductive base, and has a feeding point and a grounding point. The metal loop has at least one notch. The grounding point of the metal loop is coupled through the matching circuit to a ground voltage. An antenna structure of the wearable device is formed by the metal loop and the matching circuit.

In some embodiments, the wearable device is implemented with a watch.

In some embodiments, the nonconductive base is substantially a box without a lid, and the metal loop is disposed at an open side of the box.

In some embodiments, the wearable device further includes a PCB (Printed Circuit Board). The PCB is disposed in the nonconductive base and includes a ground plane. The ground plane provides the ground voltage.

In some embodiments, the feeding point of the metal loop is close to the first notch.

In some embodiments, the metal loop further has a second notch, and the metal loop is divided into a first portion and a second portion by the first notch and the second notch.

In some embodiments, the grounding point of the metal loop is close to the second notch.

In some embodiments, the matching circuit includes an inductor, a capacitor, or a combination thereof.

In some embodiments, the wearable device further includes a transparent element. The transparent element is surrounded by the metal loop.

In some embodiments, the antenna structure is excited to generate an operation frequency band from about 2400 MHz to about 2484 MHz.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail below.

Figure 1:
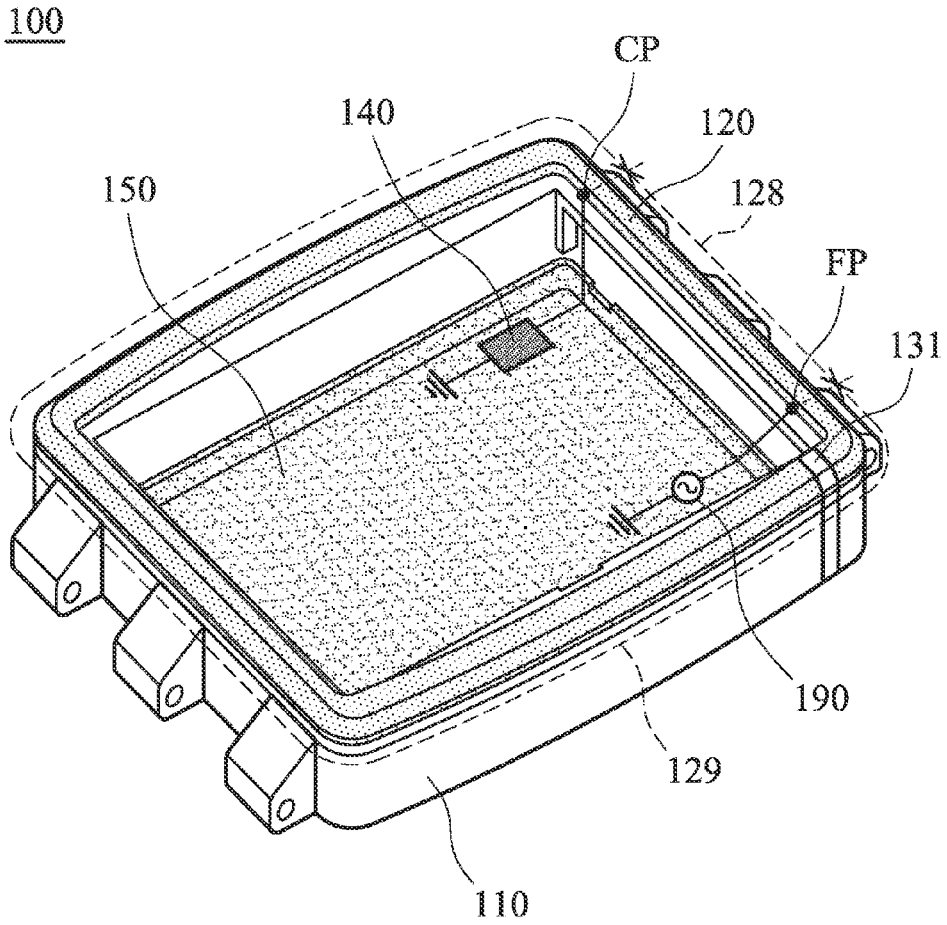
FIG. 1 is a partial combined view of a wearable device according to an embodiment of the invention.

FIG. 1 is a partial combined view of a wearable device 100 according to an embodiment of the invention. In a preferred embodiment, the wearable device 100 is a wrist-wearable device, such as a smart watch or a smart, sporty bracelet. As shown in FIG. 1, the wearable device 100 at least includes a nonconductive base 110, a metal loop 120, and a matching circuit 140.

The nonconductive base 110 may be made of plastic materials. The nonconductive base 110 substantially has a hollow structure. The shape, pattern, and surface treatment of the nonconductive base 110 are not limited in the invention. The metal loop 120 may be made of copper, silver, aluminum, iron, or their alloys. The metal loop 120 is disposed on the nonconductive base 110. The metal loop 120 has at least a first notch 131, and therefore the metal loop 120 substantially has a C-shape. The metal loop 120 has a feeding point FP and a grounding point CP. The feeding point FP is close to the first notch 131. For example, the space between the feeding point FP and the first notch 131 may be smaller than 5 mm. The matching circuit 140 is disposed in the nonconductive base 110. The matching circuit 140 provides a reactance. In some embodiments, the matching circuit 140 includes one or more capacitors, one or more inductors, or a combination thereof. The capacitors may be chip capacitors, and the inductors may be chip inductors. The grounding point CP of the metal loop 120 is coupled through the matching circuit 140 to a ground voltage. In some embodiments, the wearable device 100 further includes a PCB (Printed Circuit Board) 150. The PCB 150 is disposed in the nonconductive base 110, and includes a ground plane. The ground plane provides the aforementioned ground voltage. Other electronic components may be disposed on the PCB 150.

An antenna structure of the wearable device 100 is formed by the metal loop 120 and the matching circuit 140. The feeding point FP of the metal loop 120 may be coupled to a signal source 190, such as an RF (Radio Frequency) module for exciting the antenna structure. The positions of the feeding point FP and the grounding point CP are not limited in the invention. For example, the feeding point FP and the grounding point CP may be positioned at the same side of the metal loop 120, or respectively at two opposite sides of the metal loop 120, or respectively at two opposite corners of the metal loop 120. In some embodiments, the feeding point FP of the metal loop 120 is coupled through a pogo pin or a metal spring (not shown) to the signal source 190 on the PCB 150, and the grounding point CP of the metal loop 120 is coupled through another pogo pin or another metal spring (not shown) to the matching circuit 140 on the PCB 150.

In some embodiments, the nonconductive base 110 is substantially a box without a lid (e.g., a hollow cube without a lid to form a square opening), and the metal loop 120 is disposed at an open side of the box. The nonconductive base 110 can accommodate a variety of device components, such as a battery, an hour hand, a minute hand, a second hand, an RF module, a signal processing module, a counter, a processor, a thermometer, and/or a barometer (not shown). In some embodiments, the metal loop 120 is substantially a square loop, and it may fit a square opening of the nonconductive base 110. It should be understood that the wearable device 100 may further include other components, such as a time adjuster, a connection belt, a waterproof housing, and/or a buckle, although these components are not displayed in FIG. 1.

Figure 2:
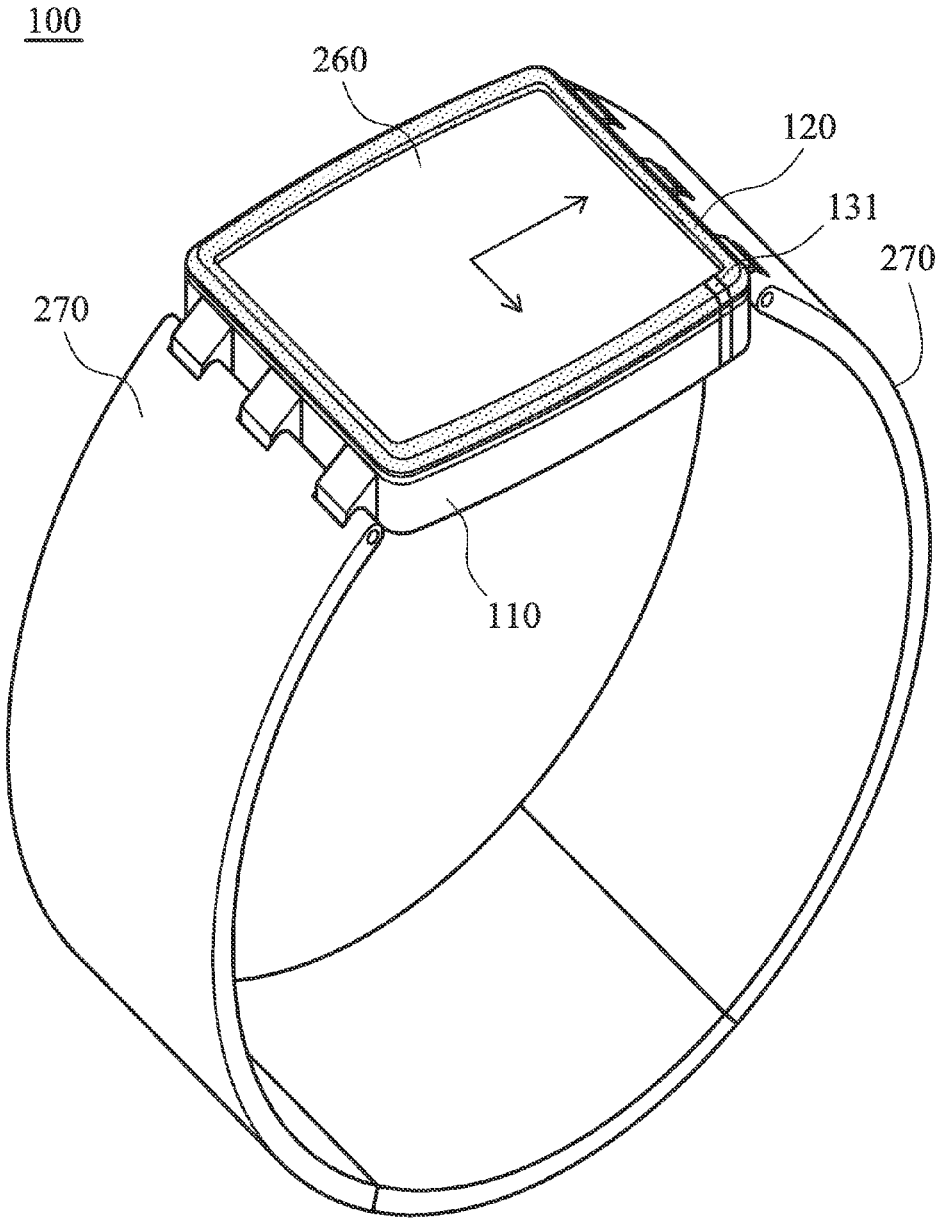
FIG. 2 is a complete combined view of a wearable device according to an embodiment of the invention.

FIG. 2 is a complete combined view of the wearable device 100 according to an embodiment of the invention. In the embodiment of FIG. 2, the wearable device 100 is implemented with a watch. With such a design, the wearable device 100 further includes a transparent element 260 and a watchband 270. For example, the transparent element 260 may be a watch surface glass or a transparent plastic board. The transparent element 260 may be disposed inside the metal loop 120, and it may be surrounded by the metal loop 120. Other watch components, such as an hour hand, a minute hand, and a second hand, may all be disposed under the transparent element 260 for the user to observe them. The watchband 270 may be connected to two opposite sides of the nonconductive base 110, so that the user can wear the wearable device 100 on the wrist using the watchband 270.

Figure 3:
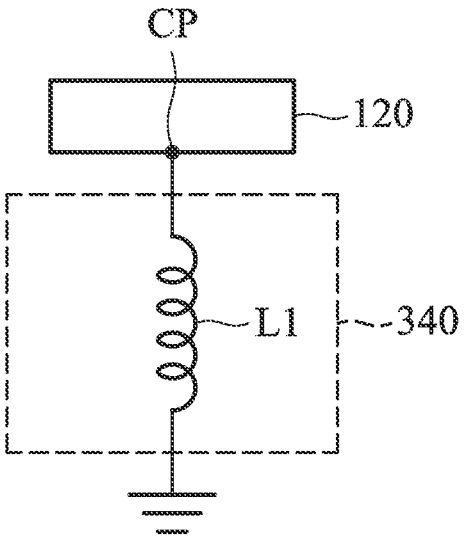
FIG. 3 is a diagram of a matching circuit according to an embodiment of the invention.

FIG. 3 is a diagram of a matching circuit 340 according to an embodiment of the invention. The matching circuit 340 of FIG. 3 may be applied to the wearable device 100 of FIG. 1 and FIG. 2. In the embodiment of FIG. 3, the matching circuit 340 includes an inductor L1. The inductance of the inductor L1 may be from about 1 nH to about 10 nH. The inductor L1 is configured to adjust the impedance matching of the wearable device 100. When the grounding point CP of the metal loop 120 is coupled through the inductor L1 to the ground voltage, the effective resonant length of the antenna structure is increased, and therefore the operation frequency band of the antenna structure is moved toward the lower frequency. In some embodiments, the inductor L1 is replaced with a variable inductor. The inductance of the variable inductor is adjustable according to a control signal or a user input signal, and therefore the inductance can correspond to a variety of operation frequencies of the antenna structure.

Figure 4:
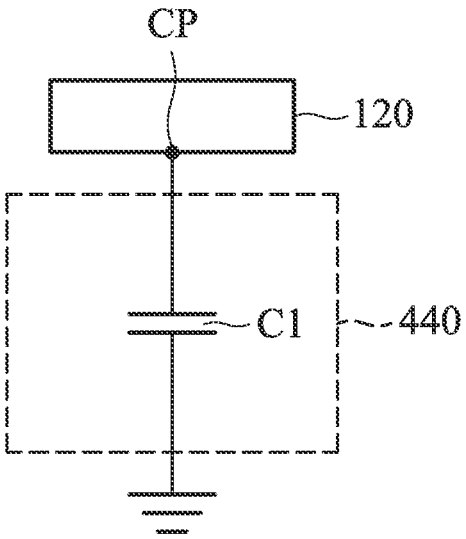
FIG. 4 is a diagram of a matching circuit according to an embodiment of the invention.

FIG. 4 is a diagram of a matching circuit 440 according to an embodiment of the invention. The matching circuit 440 of FIG. 4 may be applied to the wearable device 100 of FIG. 1 and FIG. 2. In the embodiment of FIG. 4, the matching circuit 440 includes a capacitor C1. The capacitance of the capacitor C1 may be from about 0.1 pF to about 10 pF. The capacitor C1 is configured to adjust the impedance matching of the wearable device 100. When the grounding point CP of the metal loop 120 is coupled through the capacitor C1 to the ground voltage, the effective resonant length of the antenna structure is decreased, and therefore the operation frequency band of the antenna structure is moved toward the higher frequency. In some embodiments, the capacitor C1 is replaced with a variable capacitor. The capacitance of the variable capacitor is adjustable according to a control signal or a user input signal, and therefore the capacitance can correspond to a variety of operation frequencies of the antenna structure.

It should be understood that the inner structures of the matching circuits 330 and 340 of FIG. 3 and FIG. 4 are just exemplary, and the invention is not limited thereto. In alternative embodiments, the matching circuit 140 of FIG. 1 includes one or more capacitors and/or one or more inductors. For example, the matching circuit 140 may be formed by coupling a capacitor and an inductor in series, or by coupling a capacitor and an inductor in parallel. For example, the matching circuit 140 may include a short-circuited element or an open-circuited element. By appropriately designing the matching circuit 140 to adjust the effective resonant length, the designer can make the antenna structure of the wearable device 100 operate in a variety of frequency bands, without changing the size of the metal loop 120. In some embodiments, the length of the metal loop 120 is reduced to ⅙ wavelength of the desired frequency band or shorter. Since the length of the metal loop 120 is not required to correspond to ½ or ¼ wavelength as with a conventional design, the wearable device of the invention significantly improves freedom of design for the designer.

Figure 5:
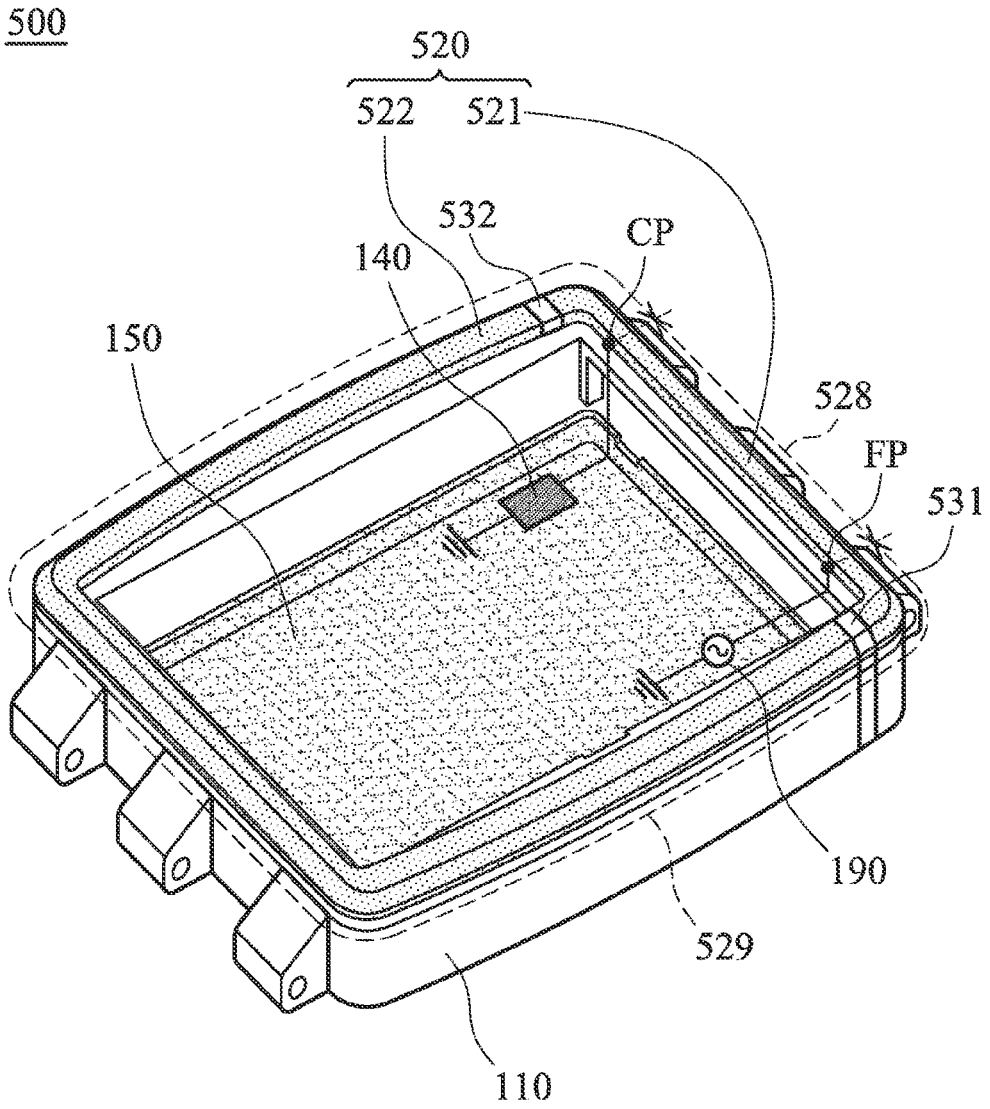
FIG. 5 is a partial combined view of a wearable device according to an embodiment of the invention.

FIG. 5 is a partial combined view of a wearable device 500 according to an embodiment of the invention. FIG. 5 is basically similar to FIG. 1 and FIG. 2. In the embodiment of FIG. 5, a metal loop 520 of the wearable device 500 has a first notch 531 and a second notch 532, such that the metal loop 520 is divided into a first portion 521 and a second portion 522 by the first notch 531 and the second notch 532. A feeding point FP of the metal loop 520 is close to the first notch 531. For example, the space between the feeding point FP and the first notch 531 may be smaller than 5 mm. A grounding point CP of the metal loop 520 is close to the second notch 532. For example, the space between the grounding point CP and the second notch 532 may be smaller than 5 mm. The first portion 521 of the metal loop 520 has a relatively short length, and substantially has a straight-line shape. The second portion 522 of the metal loop 520 has a relatively long length, and substantially has a C-shape. Other features of the wearable device 500 of FIG. 5 are similar to those of the wearable device 100 of FIG. 1 and FIG. 2. Therefore, the two embodiments can achieve similar levels of performance.

Figure 6:
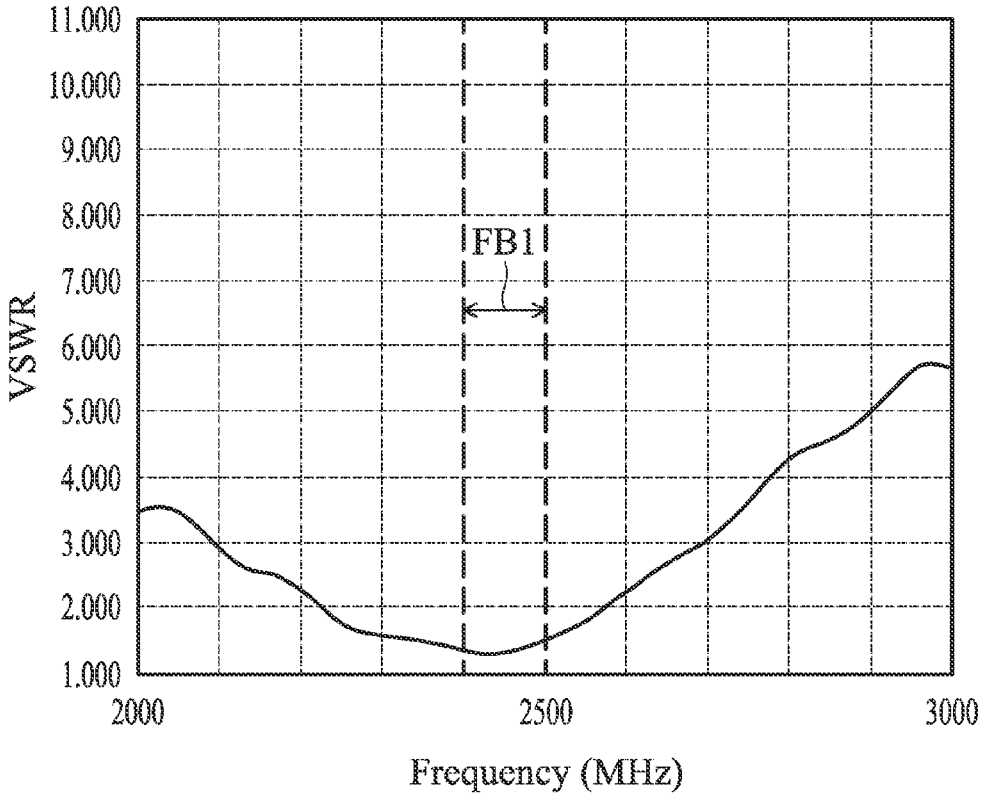
FIG. 6 is a VSWR (Voltage Standing Wave Ratio) of an antenna structure of a wearable device according to an embodiment of the invention.

FIG. 6 is a VSWR (Voltage Standing Wave Ratio) of the antenna structure of the wearable device 100 according to an embodiment of the invention. The horizontal axis represents the operation frequency (MHz), and the vertical axis represents the VSWR. According to the measurement result of FIG. 6, when the metal loop 120 of the wearable device 100 is fed from the signal source 190, the antenna structure is excited to generate at least one operation frequency band FB1. In some embodiments, the operation frequency band FB1 of the antenna structure is substantially from 2400 MHz to 2484 MHz. As a result, the wearable device 100 of the invention can support at least the wireless communication of Wi-Fi and Bluetooth frequency bands. Since the metal loop 120 is implemented with a light, thin metal piece and is used in such a way that it contributes to the overall appearance of the wearable device 100, the present invention has the advantages of minimizing the antenna size, keeping the antenna bandwidth, reducing the manufacturing cost, and improving the device's appearance, and it is suitable for application in a variety of small, smart, wearable devices.

Please refer to FIG. 1 again and understand the antenna theory and design method of the invention. Due to the shape characteristics of the metal loop 120, the antenna structure of the wearable device 100 has a first resonant path 128 and a second resonant path 129. The first resonant path 128 is a shorter portion of the path from the feeding point FP to the grounding point CP of the metal loop 120. The second resonant path 129 is a longer portion of the path from the grounding point CP to the first notch 131 of the metal loop 120. A combination of the first resonant path 128 and the second resonant path 129 covers a complete metal loop 120. As to the antenna theory, the operation band FB1 of FIG. 6 is generally excited by the shorter first resonant path 128, and then fine-tuned by the matching circuit 140. Therefore, the designer can appropriately change the positions of the feeding point FP and the grounding point CP, so as to easily control the operation band FB1 of the antenna structure.

In the case of FIG. 5, as to the antenna theory, the operation band FB1 of the antenna structure of the wearable device 500 is generally excited by the first portion 521 of the metal loop 520 (including a first resonant path 528 from the feeding point FP to the grounding point CP of the metal loop 120), and then fine-tuned by the matching circuit 140. This antenna theory is similar to that of the antenna structure of the wearable device 100 of FIG. 1.

Figure 7:
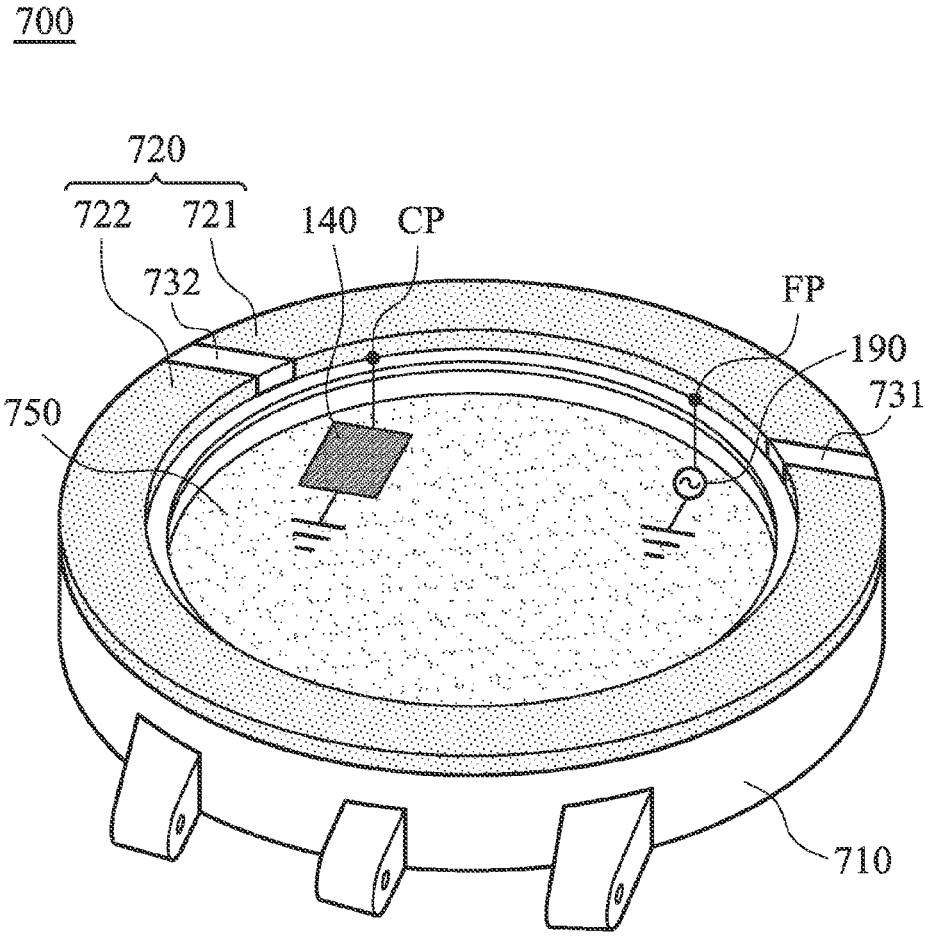
FIG. 7 is a partial combined view of a wearable device according to an embodiment of the invention.

FIG. 7 is a partial combined view of a wearable device 700 according to an embodiment of the invention. FIG. 7 is similar to FIG. 1 and FIG. 2. In the embodiment of FIG. 7, a nonconductive base 710 of the wearable device 700 is substantially a hollow cylinder without a lid, and has a circular opening. In addition, a metal loop 720 of the wearable device 700 is substantially a circular loop, and it may fit the circular opening of the nonconductive base 710. In alternative embodiments, adjustments are made such that the nonconductive base 710 is substantially a hollow elliptical cylinder without a lid, and the metal loop 720 is substantially an elliptical loop. The metal loop 720 may have only a first notch 731, or it may have both a first notch 731 and a second notch 732. Other features of the wearable device 700 of FIG. 7 are similar to those of the wearable device 100 of FIG. 1 and FIG. 2. Therefore, the two embodiments can achieve similar levels of performance.

Figure 8:
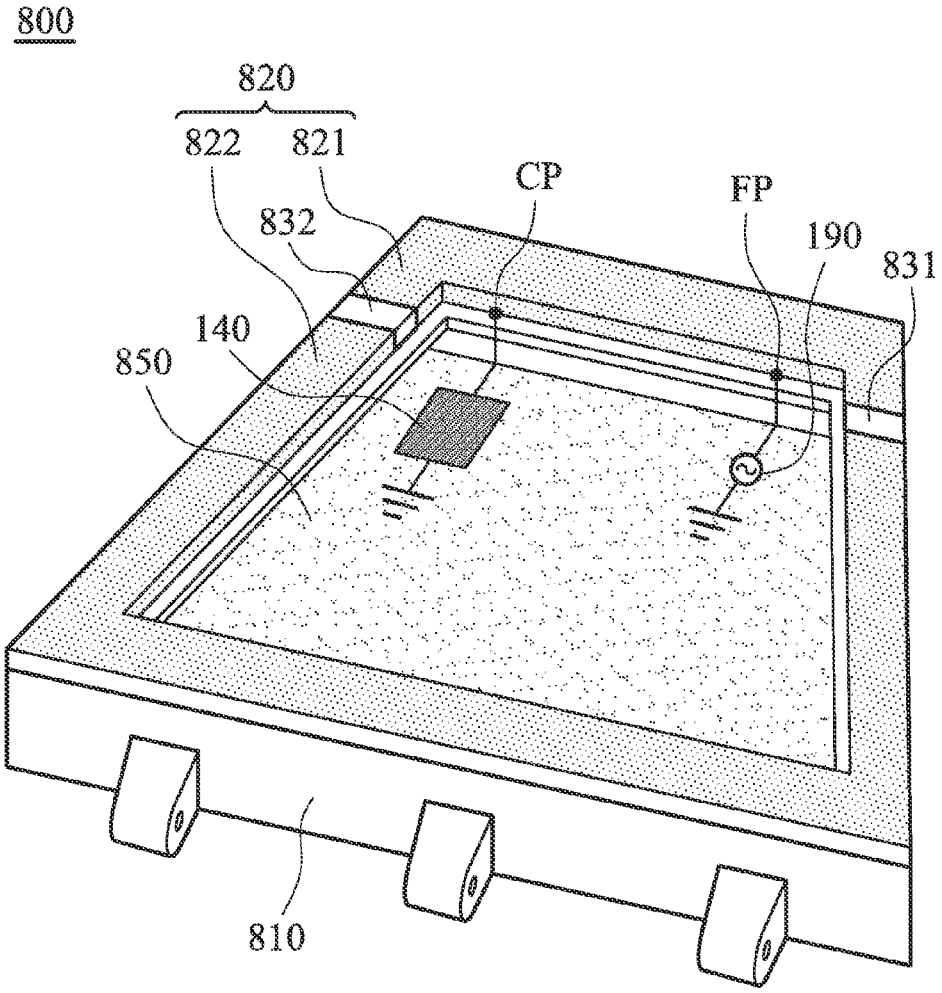
FIG. 8 is a partial combined view of a wearable device according to an embodiment of the invention.

FIG. 8 is a partial combined view of a wearable device 800 according to an embodiment of the invention. FIG. 8 is similar to FIG. 1 and FIG. 2. In the embodiment of FIG. 8, a nonconductive base 810 of the wearable device 800 is substantially a hollow trapezoidal cylinder without a lid, and it has a trapezoidal opening. In addition, a metal loop 820 of the wearable device 800 is substantially a trapezoidal loop, and it may fit the trapezoidal opening of the nonconductive base 810. The metal loop 820 may have only a first notch 831, or it may have both a first notch 831 and a second notch 832. Other features of the wearable device 800 of FIG. 8 are similar to those of the wearable device 100 of FIG. 1 and FIG. 2. Therefore, the two embodiments can achieve similar levels of performance.

The invention proposes a novel wearable device, and its antenna structure is integrated with its decorative metal element. Furthermore, a matching circuit and a notch of metal element are incorporated so as to adjust the resonant length, and therefore the invention has both improved functionality and improved appearance.

Note that the element sizes, element shapes, and frequency ranges described above are not limitations of the invention. An antenna designer can adjust these settings or values according to different requirements. It should be understood that the wearable device and the antenna structure of the invention are not limited to the configurations of FIGS. 1-8. The invention may merely include any one or more features of any one or more embodiments of FIGS. 1-8. In other words, not all of the features shown in the figures should be implemented in the wearable device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A wearable device, comprising:

a nonconductive base, substantially having a hollow structure;

a metal loop, disposed on the nonconductive base, and having a feeding point and a grounding point, wherein the metal loop has at least a first notch; and a matching circuit, wherein the grounding point of the metal loop is coupled through the matching circuit to a ground voltage;

wherein an antenna structure is formed by the metal loop and the matching circuit;

wherein the metal loop further has a second notch, and the metal loop is divided into a first portion and a second portion by the first notch and the second notch;

wherein the feeding point of the metal loop is close to the first notch, and the grounding point of the metal loop is close to the second notch;

wherein the wearable device is implemented with a watch, and the metal loop is not a band of the watch.

2. The wearable device as claimed in claim 1, wherein the nonconductive base is substantially a box without a lid, and the metal loop is disposed at an open side of the box.

3. The wearable device as claimed in claim 1, further comprising:

a PCB (Printed Circuit Board), disposed in the nonconductive base, and comprising a ground plane, wherein the ground plane provides the ground voltage.

4. The wearable device as claimed in claim 1, wherein the matching circuit comprises an inductor, a capacitor, or a combination thereof.

5. The wearable device as claimed in claim 1, further comprising:

a transparent element, wherein the transparent element is surrounded by the metal loop.

6. The wearable device as claimed in claim 1, wherein the antenna structure is excited to generate an operation frequency band from about 2400 MHz to about 2484 MHz.

* * * * *